US010711357B2

(12) United States Patent
Zheng

(10) Patent No.: US 10,711,357 B2
(45) Date of Patent: Jul. 14, 2020

(54) GRAPHITE ELECTRODE AND MANUFACTURING PROCESS THEREOF, AND A CARBON DIOXIDE GENERATOR

(71) Applicant: Ningbo Dayang Industry and Trade Co., Ltd., Zhejiang (CN)

(72) Inventor: Jun Zheng, Zhejiang (CN)

( * ) Notice: Subject to any disclaimer, the term of this patent is extended or adjusted under 35 U.S.C. 154(b) by 102 days.

(21) Appl. No.: 15/823,572

(22) Filed: Nov. 28, 2017

(65) Prior Publication Data

US 2019/0161873 A1 May 30, 2019

(51) Int. Cl.

| | |
|---|---|
| ***C25B 11/04*** | (2006.01) |
| ***C25B 1/04*** | (2006.01) |
| ***C25B 11/12*** | (2006.01) |
| ***C25B 11/00*** | (2006.01) |
| ***C25B 1/00*** | (2006.01) |
| ***C25B 9/06*** | (2006.01) |

(52) U.S. Cl.

CPC ..... *C25B 11/12* (2013.01); *C25B 1/00* (2013.01); *C25B 9/06* (2013.01); *C25B 11/00* (2013.01)

(58) Field of Classification Search

CPC ..... C25B 11/12; C25B 11/04; C25B 11/0426; C25B 1/04; C25B 11/02

See application file for complete search history.

(56) References Cited

U.S. PATENT DOCUMENTS

2017/0200974 A1* 7/2017 Maruo ..... H01M 10/0568

* cited by examiner

*Primary Examiner* — Zulmariam Mendez

(74) *Attorney, Agent, or Firm* — Prakash Nama; Global IP Services, PLLC

(57) ABSTRACT

The present invention relates to a graphite electrode and manufacturing process thereof, and a carbon dioxide generator, wherein the graphite electrode comprises the following in weight percentage: graphite powder 50%-90%; adhesive 10%-40%; first additive 1%-30%; second additive 0.1%-10%; wherein the adhesive comprises at least one of phenolic resin, bisphenol A epoxy resin and urea formaldehyde resin; the first additive is selected from at least one of the following: polylactic acid, carbonate, monosaccharide, oligosaccharide and polymethacrylates; the second additive is selected from at least one of the following: carbon black, carbon nanotubes, silicon carbide, boron nitride, silicon oxide, aluminium oxide, zinc oxide, iron oxide, titanium dioxide, calcium carbonate, stearic acid, zinc stearate and calcium stearate. The carbon dioxide concentration of the gas obtained by the electrolysis of the present invention reaches 10 v % or more, and the gas produced is stable in quantity.

8 Claims, 3 Drawing Sheets

GRAPHITE ELECTRODE AND MANUFACTURING PROCESS THEREOF, AND A CARBON DIOXIDE GENERATOR

BACKGROUND OF THE INVENTION

Graphite is used as electrode for producing carbon dioxide during electrolysis. The carbon dioxide in the electrolytic gas is within 1-2 v %, and the carbon dioxide concentration is very low. As an attractant for mosquitoes and insects, conventional carbon dioxide generator with graphite electrode could not produce carbon dioxide with sufficient concentration to effectively attract mosquitoes and insects.

BRIEF SUMMARY OF THE INVENTION

In view of the aforesaid disadvantages now present in the prior art, the present invention provides a graphite electrode which significantly increases carbon dioxide concentration in electrolytic gas under same electrolysis conditions.

In view of the aforesaid disadvantages now present in the prior art, the present invention further provides a manufacturing process of graphite electrode which significantly increases carbon dioxide concentration in electrolytic gas under same electrolysis conditions.

In view of the aforesaid disadvantages now present in the prior art, the present invention further provides a carbon dioxide generator which provides up to 10 v % of carbon dioxide concentration in electrolytic gas.

To attain this, the graphite electrode of the present invention comprises the following in weight percentage:

| | |
|---|---|
| Graphite powder | 50%-90% |
| Adhesive | 10%-40% |
| First additive | 1%-30% |
| Second additive | 0.1%-10% |

The adhesive comprises at least one of phenolic resin, bisphenol A epoxy resin and urea formaldehyde resin.

The first additive is selected from at least one of the following: polylactic acid, carbonate, monosaccharide, oligosaccharide and polymethacrylates.

The second additive is selected from at least one of the following: carbon black, carbon nanotubes, silicon carbide, boron nitride, silicon oxide, aluminium oxide, zinc oxide, iron oxide, titanium dioxide, calcium carbonate, stearic acid, zinc stearate and calcium stearate.

The graphite electrode further comprises hexamethylenetetramine. The hexamethylenetetramine is present in an amount of 5-15 weight percentage of the adhesive.

The manufacturing process of the graphite electrode comprises the following steps:

Mixing all components evenly to obtain a mixture, and then heat pressing and curing the mixture in a mold under 100-300 degrees Celsius and 10-60 MPa to obtain the graphite electrode.

The carbon dioxide generator utilizing the graphite electrode of the above technical schemes is characterized in that it comprises a box body for receiving an electrolyte solution; a partition plate, a graphite electrode and a cathode plate are sealingly connected to an upper open end of the box body; the graphite electrode and the cathode plate are electrically connected to an electrolysis circuit; a ventilation hole is disposed on the partition plate.

Preferably, the box body is disposed inside a casing; the electrolysis circuit is disposed inside the casing and positioned outside the box body; a battery for powering the electrolysis circuit is disposed inside the casing; a charging port for charging the battery is provided on a side wall of the casing; gas discharge openings are provided on a top side of the casing; the gas discharge openings communicate with the ventilation hole. In this way, the box body may be independently used as consumables; it has good energy saving and consumption reducing effects and is more environmental friendly.

Preferably, the cathode plate has a U-shaped cross section; the cathode plate encompasses the graphite electrode; the cathode plate and the graphite electrode are electrically connected to a negative terminal and a positive terminal of the electrolysis circuit respectively.

In order to facilitate control of the amount of carbon dioxide produced, an electric current adjustment switch for controlling output electric current strength of the electrolysis circuit may be provided on the casing. The amount of carbon dioxide produced is controlled by adjustment output electric current strength; control is easy and convenient and it is safe to use.

As an improvement on the above technical schemes, the casing may comprise a base and a cover removably snapped on the base; the casing is divided by the partition plate into an upper cavity and a lower cavity; the box body, the battery and the electrolysis circuit are disposed inside the lower cavity; a plurality of gas discharge openings which communicate with the ventilation hole and the upper cavity are provided on the casing (5); the gas discharge openings are provided evenly along a periphery of the casing. In this technical scheme, it is possible to replace only the box body and the electrolysis components therein when replacing the carbon dioxide generator. It has good energy saving and consumption reducing effects and is more environmental friendly.

A liquid injection opening for adding an electrolyte solution into the box body may be provided on the box body. In this way, the electrolyte solution is added to the box body during use; transportation is convenient and safety of transport and storage is further ensured.

The electrolyte solution in the carbon dioxide generator may select from any one in prior art according to needs. Preferably, the box body contains the electrolyte solution. The electrolyte solution is an aqueous solution of sulfate and/or bicarbonate. The electrolyte solution further comprises 0-10 weight percentage of glucose. The electrolyte solution has a pH value of 6-9. The aforementioned electrolyte solution could interact with the graphite electrode to increase the carbon dioxide in the electrolytic gas. In particular, after adding glucose, the carbon dioxide in the electrolytic gas can be increased by about 2 v %.

In comparison with the prior art, when the graphite electrode of the present invention is used as the anode plate in the electrolytic cell of the carbon dioxide generator, the carbon dioxide in the gas produced by electrolysis could reach 10 v % or more, and the gas produced is stable in quantity. It is especially suitable for use as consumables in mosquito-killing apparatus and plant growth apparatus. It is easy to replace, and has good energy saving and consumption reducing effects and is more environmental friendly.

DETAILED DESCRIPTION OF THE INVENTION

The present invention is further described with a preferred embodiment and the accompanying drawings.

Embodiment 1

Figure 1:
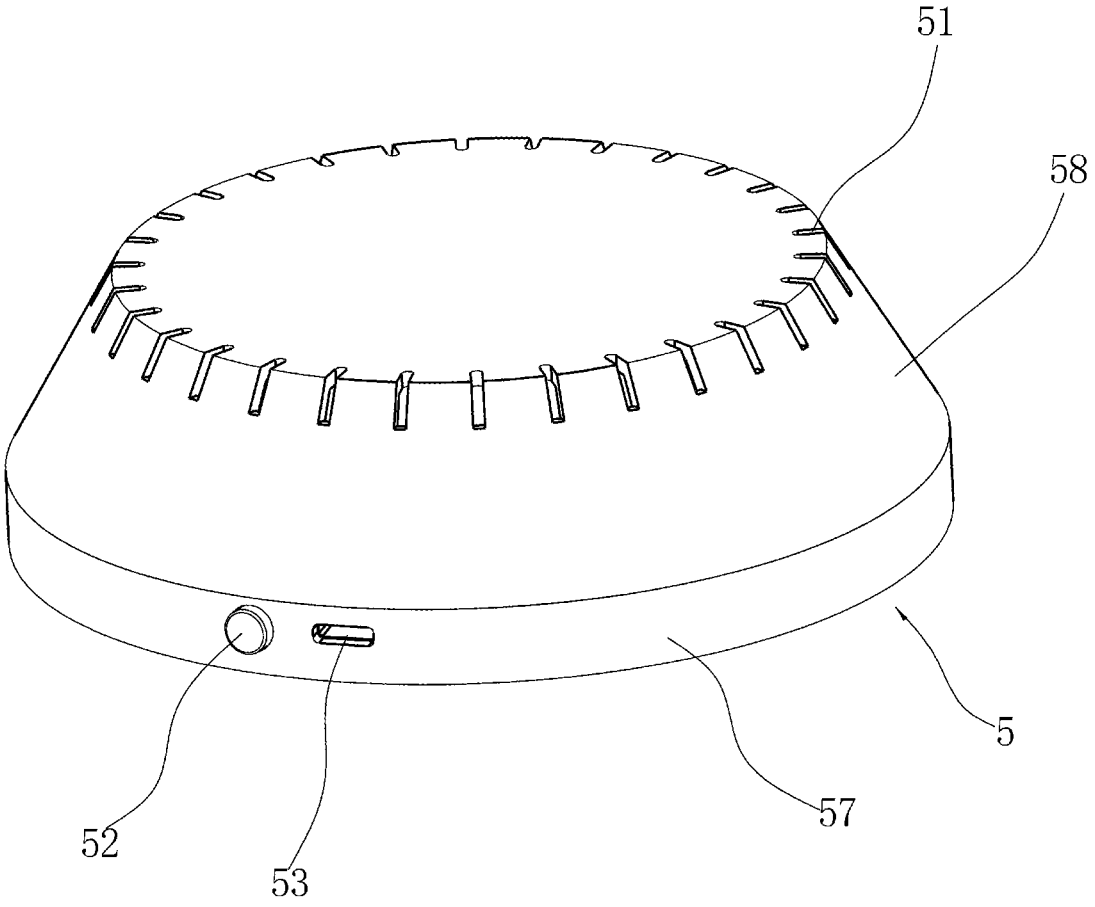
FIG. 1 is a perspective view of the assembled structure of the embodiment 1 of the present invention.
Figure 2:
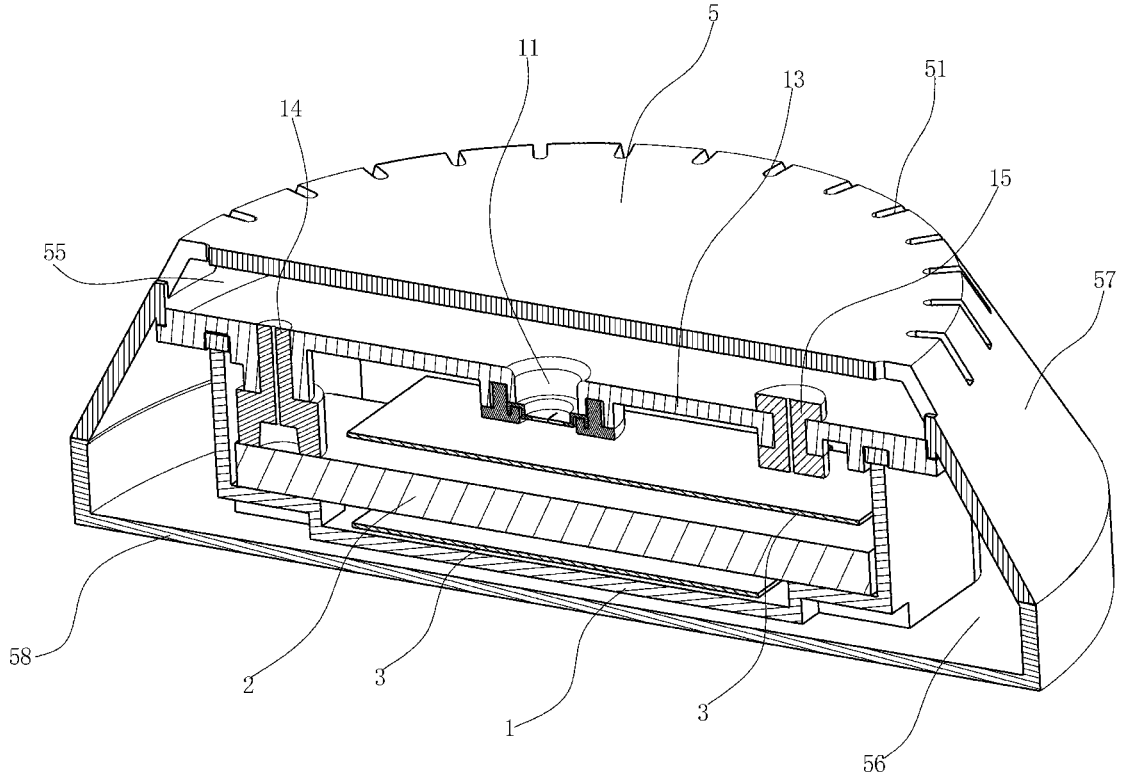
FIG. 2 is a vertical sectional view of FIG. 1.
Figure 3:
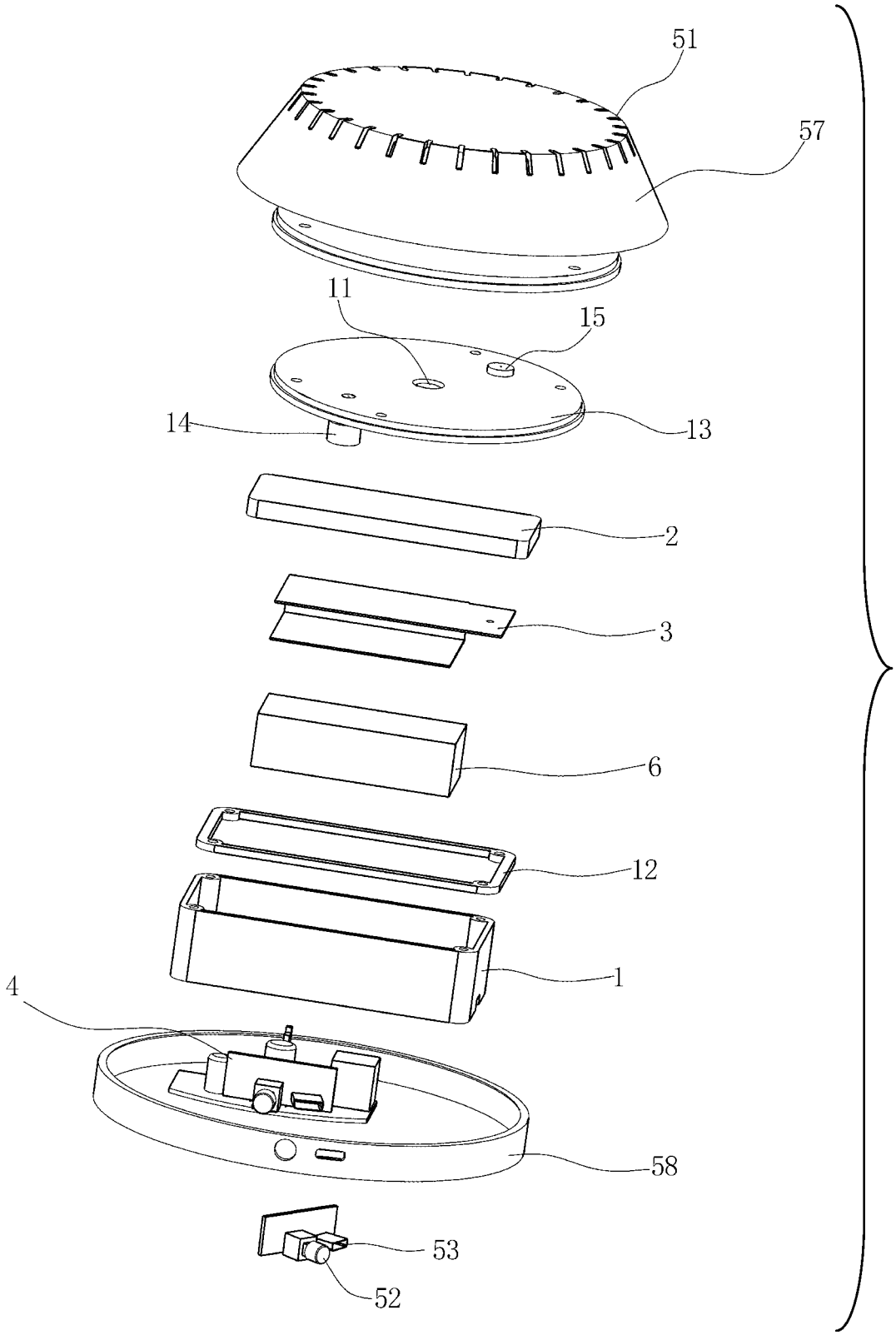
FIG. 3 is a perspective view of the disassembled structure of the embodiment 1 of the present invention.

As illustrated in FIGS. 1 to 3, the carbon dioxide generator comprises:

a box body 1 for receiving an electrolyte solution, a graphite electrode 2 and a cathode plate 3. The box body 1 of the present embodiment is an open end container having an upper open end sealingly connected to a partition plate 13 via a sealing ring 12. The partition plate 13 divides an internal cavity of a casing 5 into a lower cavity 56 and an upper cavity 55 which are isolated from each other. A ventilation hole 11 which communicates with the box body 1, and a positive connection rod 14 and a negative connection rod 15 which connect to an electrolysis circuit 4 respectively are disposed on the partition plate. The positive connection rod 14 is electrically connected to the graphite electrode 2. The negative connection rod 15 is electrically connected to the cathode plate 3.

In the present embodiment, the cathode plate 3 has a U-shaped cross section and encompasses the graphite electrode 2.

The casing 5 comprises a base 57 and a cover 58 removably snapped on the base 57. The internal cavity of the casing 5 is divided by the partition plate 13 into the lower cavity 56 and the upper cavity 55. The upper cavity 55 serves as a gas storage cavity for storing and providing a buffer for the electrolytic gas discharged from the ventilation hole 11.

The box body 1, a battery 6 and the electrolysis circuit 4 are disposed inside the lower cavity 56. The battery 6 is electrically connected to the electrolysis circuit 4. A charging port 52 for charging the battery 6 and an electric current adjustment switch 53 for controlling the electric current strength of the electrolysis circuit 4 are provided on a side wall of the casing 5.

The positive connection rod 15 and the negative connection rod 14 are both electrically connected to the electrolysis circuit 4.

A plurality of gas discharge openings 51 which communicate with the upper cavity 55 are provided on a top side of the casing 5. The gas discharge openings 5 are provided evenly along a periphery of the casing 5.

In the present embodiment, an electrolyte solution is added into the box body 1. The electrolyte solution is an aqueous solution of sodium sulfate and glucose. The sodium sulfate has a concentration of 5 wt %; the glucose has a concentration of 2 wt %. The electrolyte solution has a pH value of 7. The sodium sulfate may be replaced by salts such as sodium bicarbonate, potassium sulfate, potassium bicarbonate and so forth.

The box body may also be filled with no electrolyte solution. The casing may be provided with a liquid injection tube (not shown in the drawings) which communicates with an internal cavity of the box body so that users may add the electrolyte solution to the box body on their own via the liquid injection tube during use.

The manufacturing process of the graphite electrode 2 of the present embodiment is as follows:

Obtain the following components: 70% of graphite powder, 18% of adhesive, 2% of hexamethylenetetramine, 8% of a first additive and 2% of a second additive, wherein the adhesive is thermoplastic phenolic resin 2123, the first additive is polymethacrylates and the second additive is stearic acid.

Each of the above components is in powder form.

Mixing all components evenly to obtain a mixture, and then heat pressing and curing the mixture in a mold under 200 degrees Celsius and 40 MPa to obtain the graphite electrode 2.

Embodiments 2 to 8

The carbon dioxide generator in Embodiments 2 to 8 has the same structure as the carbon dioxide generation in Embodiment 1, but the compositions of the electrolyte solution and the graphite electrode are different. Please refer to Table 1 for details. In Table 1, the remaining amount is the graphite amount, i.e. after adding the graphite amount the total would be 100%.

Control

The carbon dioxide generator used in the Control has the same structure as the carbon dioxide generator in Embodiment 1, but the graphite electrode used is a conventional graphite electrode in the prior art, and the electrolyte solution is water.

TABLE 1

| Composition | Adhesive | Hexamethyl-enetetramine | First additive | Second additive | Electrolyte solution |
|---|---|---|---|---|---|
| Embodiment 2 | thermoplastic phenolic resin 2123, 12% | 1% | polylactic acid, 8% | calcium carbonate, 5%<br>carbon nanotubes, 0.5%<br>calcium stearate, 1%<br>aluminium oxide, 0.5% | 1% sodium bicarbonate |
| Embodiment 3 | bisphenol A epoxy resin, 18%<br>phenolic resin, 5% | 2% | glucose, 5% | carbon black, 1%<br>zinc oxide, 2%<br>silicon dioxide, 1%<br>zinc stearate, 1%<br>silicon carbide, 0.5% | 3% sodium sulfate |

TABLE 1-continued

| Composition | Adhesive | Hexamethyl-enetetramine | First additive | Second additive | Electrolyte solution |
|---|---|---|---|---|---|
| Embodiment 4 | phenolic resin, 15% urea formaldehyde resin, 5% | 1.5% | sucrose, 4% propylene carbonate, 1% | carbon black, 1% iron oxide, 0.5% titanium dioxide, 0.2% boron nitride, 2% stearic acid, 1.5% | 1% sodium bicarbonate + 1% sodium sulfate |
| Embodiment 5 | phenolic resin 2122, 22% | | glucose, 3% | carbon black, 1% calcium carbonate, 2% stearic acid, 1% silicon carbide, 1% | 3% sodium bicarbonate |
| Embodiment 6 | phenolic resin 2127, 15% | | polylactic acid, 5% polymethacrylates, 5% | calcium stearate, 2% carbon black, 1% aluminium oxide, 0.5% iron oxide, 0.5% | 1% sodium bicarbonate |
| Embodiment 7 | bisphenol A epoxy resin, 18% | 2% | polymethacrylates, 5% propylene carbonate, 2% | carbon nanotubes, 1% calcium stearate, 2% titanium dioxide, 0.5% silicon carbide, 1% | 3% sodium bicarbonate |
| Embodiment 8 | urea formaldehyde resin, 25% | | polylactic acid, 6% glucose, 2% | zinc stearate, 2% carbon black, 2% silicon carbide 1% | 5% sodium sulfate |

Under same electric current, testing is conducted on Embodiments 1 to 8 and the Control, and gas produced from electrolysis is collected and analyzed. In Embodiments 1 to 8, 1 L of gas is produced, wherein the carbon dioxide concentration is 10 v %-12 v %. In the Control, 1 L of gas is collected, wherein the carbon dioxide concentration is 1 v %.

What is claimed is:

1. A graphite electrode, characterized in that it comprises the following in weight percentage:

| | |
|---|---|
| Graphite powder | 50%-90% |
| Adhesive | 10%-40% |
| First additive | 1%-30% |
| Second additive | 0.1%-10% |

Wherein, the adhesive comprises at least one of phenolic resin, bisphenol A epoxy resin and urea formaldehyde resin;

the first additive is selected from at least one of the following: polylactic acid, carbonate, monosaccharide, oligosaccharide and polymethacrylates;

the second additive is selected from at least one of the following: carbon black, carbon nanotubes, silicon carbide, boron nitride, silicon oxide, aluminium oxide, zinc oxide, iron oxide, titanium dioxide, calcium carbonate, stearic acid, zinc stearate and calcium stearate;

the graphite electrode further comprises hexamethylenetetramine; the hexamethylenetetramine is present in an amount of 5-15 weight percentage of the adhesive.

2. A carbon dioxide generator utilizing the graphite electrode as in claim 1, characterized in that it comprises a box body (1) for receiving an electrolyte solution; a partition plate (13), a graphite electrode (2) and a cathode plate (3) are sealingly connected to an upper open end of the box body (1); the graphite electrode (2) and the cathode plate (3) are electrically connected to an electrolysis circuit (4); a ventilation hole (11) is disposed on the partition plate (13).

3. The carbon dioxide generator as in claim 2, characterized in that the box body (1) is disposed inside a casing; the electrolysis circuit (4) is disposed inside the casing and positioned outside the box body (1); a battery (6) for powering the electrolysis circuit (4) is disposed inside the casing (5); a charging port (52) for charging the battery (6) is provided on a side wall of the casing (5); gas discharge openings (51) are provided on a top side of the casing (5); the gas discharge openings (51) communicate with the ventilation hole (11).

4. The carbon dioxide generator as in claim 3, characterized in that the cathode plate (3) has a U-shaped cross section; the cathode plate (3) encompasses the graphite electrode (2); the cathode plate (3) and the graphite electrode (2) are electrically connected to a negative terminal and a positive terminal of the electrolysis circuit (4) respectively.

5. The carbon dioxide generator as in claim 4, characterized in that an electric current adjustment switch (53) for controlling output electric current strength of the electrolysis circuit (4) is provided on the casing (5).

6. The carbon dioxide generator as in claim 4, characterized in that the casing (5) comprises a base (57) and a cover (58) removably snapped on the base (57); the casing (5) is divided by the partition plate (13) into an upper cavity (55) and a lower cavity (56); the box body (1), the battery (6) and the electrolysis circuit (4) are disposed inside the lower cavity (56); a plurality of gas discharge openings (51) which communicate with the ventilation hole (11) and the upper cavity (55) are provided on the casing (5); the gas discharge openings (5) are provided evenly along a periphery of the casing (5).

7. The carbon dioxide generator as in claim 6, characterized in that a liquid injection opening for adding an electrolyte solution into the box body (1) is provided on the box body (1).

8. The carbon dioxide generator as in claim 6, characterized in that the box body (1) contains an electrolyte solution, the electrolyte solution is an aqueous solution of sulfate and/or bicarbonate; the electrolyte solution further comprises 0-10 wt % of glucose; the electrolyte solution has a pH value of 6-9.

* * * * *